US011806840B2

(12) United States Patent
Xiao et al.

(10) Patent No.: US 11,806,840 B2
(45) Date of Patent: Nov. 7, 2023

(54) ABRASIVE ARTICLE AND METHOD OF FORMING

(71) Applicants: SAINT-GOBAIN ABRASIVES, INC., Worcester, MA (US); SAINT-GOBAIN ABRASIFS, Conflans-Sainte-Honorine (FR)

(72) Inventors: Ji Xiao, Shanghai (CN); Aiyun Luo, Shanghai (CN); Gwenaëlle Ringenbach, Bascharage (LU); Ignazio Gosamo, Léglise (BE); Lise Lauvergeon, Bascharage (LU)

(73) Assignees: SAINT-GOBAIN ABRASIVES, INC., Worcester, MA (US); SAINT-GOBAIN ABRASIFS, Conflans-Sainte-Honorine (FR)

( * ) Notice: Subject to any disclaimer, the term of this patent is extended or adjusted under 35 U.S.C. 154(b) by 0 days.

(21) Appl. No.: 17/932,930

(22) Filed: Sep. 16, 2022

(65) Prior Publication Data

US 2023/0018588 A1 Jan. 19, 2023

Related U.S. Application Data

(63) Continuation of application No. 16/914,004, filed on Jun. 26, 2020, now Pat. No. 11,478,898.

(30) Foreign Application Priority Data

Jun. 28, 2019 (CN) ..... 201910584014.5

(51) Int. Cl.
*B24D 3/18* (2006.01)
*B24D 18/00* (2006.01)

(52) U.S. Cl.
CPC ..... *B24D 3/18* (2013.01); *B24D 18/0072* (2013.01)

(58) Field of Classification Search
CPC ..... B24D 3/18; B24D 18/0072
See application file for complete search history.

(56) References Cited

U.S. PATENT DOCUMENTS 3,594,141 A 7/1971 Houston et al.
4,871,008 A 10/1989 Dwivedi et al.
(Continued)

FOREIGN PATENT DOCUMENTS

CN 101544851 B 1/2012
CN 102001053 B 7/2012
(Continued)

OTHER PUBLICATIONS

International Search Report and Written Opinion for PCT/US2020/039956, dated Oct. 15, 2020, 12 pages.
(Continued)

*Primary Examiner* — Pegah Parvini
(74) *Attorney, Agent, or Firm* — Abel Schillinger, LLP; Arpan Ghosh

(57) ABSTRACT

An abrasive article can include an abrasive component including a body. The body can include a bond matrix and abrasive particles contained in the bond matrix. In an embodiment, the body can include an interconnected phase extending through at least a portion of the bond matrix. The body can include a discontinuous phase including a plurality of discrete members. At least one of the discrete member can include a macroscopic pore. In another embodiment, the body can include a porosity of at least 15 vol % for a total volume of the body.

20 Claims, 6 Drawing Sheets

(56) References Cited

U.S. PATENT DOCUMENTS

| | | | | |
|---|---|---|---|---|
| 5,221,294 | A | 6/1993 | Carman et al. | |
| 5,505,750 | A | 4/1996 | Andrews | |
| 5,925,836 | A | 7/1999 | Krause et al. | |
| 5,932,508 | A | 8/1999 | Armstrong et al. | |
| 5,976,205 | A | 11/1999 | Andrews et al. | |
| 6,102,789 | A | 8/2000 | Ramanath et al. | |
| 6,117,205 | A | 9/2000 | Krause et al. | |
| 6,286,498 | B1 | 9/2001 | Sung | |
| 8,333,814 | B2 | 12/2012 | Brackin et al. | |
| 11,383,350 | B2 | 7/2022 | Rifaut et al. | |
| 2009/0084042 | A1 | 4/2009 | Ramanath et al. | |
| 2010/0000159 | A1 | 1/2010 | Walia et al. | |
| 2010/0035530 | A1 | 2/2010 | Gosamo et al. | |
| 2010/0159806 | A1* | 6/2010 | Wu ..... | C09K 3/1418 451/28 |
| 2011/0165826 | A1 | 7/2011 | Hoang et al. | |
| 2013/0344786 | A1 | 12/2013 | Keipert | |
| 2014/0069023 | A1 | 3/2014 | Hoang et al. | |
| 2017/0151652 | A1 | 6/2017 | Ogura | |
| 2018/0126515 | A1 | 5/2018 | Franke et al. | |
| 2021/0001452 | A1 | 1/2021 | Xiao et al. | |

FOREIGN PATENT DOCUMENTS

| | | | |
|---|---|---|---|
| CN | 103395009 | A | 11/2013 |
| EP | 0688634 | A2 | 12/1995 |
| EP | 1066134 | B1 | 5/2002 |
| EP | 0946332 | B1 | 6/2004 |
| EP | 1645365 | A1 | 12/2006 |
| JP | H0326467 | A | 2/1991 |
| JP | H0691536 | A | 4/1994 |
| JP | H07205033 | A | 8/1995 |
| JP | 2006007360 | A | 1/2006 |
| JP | 2010188447 | A | 9/2010 |
| JP | 2010540261 | A | 12/2010 |
| JP | 2014168843 | A | 9/2014 |
| WO | 9810110 | A1 | 3/1998 |
| WO | 2018125722 | A1 | 7/2018 |
| WO | 2018160297 | A1 | 9/2018 |
| WO | 2020264397 | A1 | 12/2020 |

OTHER PUBLICATIONS

Extended European Search Report for EP20833677.6, dated Jun. 6, 2023, 11 pages.

* cited by examiner

ABRASIVE ARTICLE AND METHOD OF FORMING

CROSS-REFERENCE TO RELATED APPLICATION(S)

This application is a continuation and claims priority under 35 U.S.C. § 120 to U.S. patent application Ser. No. 16/914,004 entitled, "ABRASIVE ARTICLE AND METHOD OF FORMING," by Ji XIAO et al., filed Jun. 26, 2020, which application claims priority to Chinese Patent Application No. 201910584014.5, filed Jun. 28, 2019, entitled "ABRASIVE ARTICLE AND METHOD OF FORMING," by Ji XIAO et al., of which all are assigned to the current assignee hereof and incorporated herein by reference in their entireties.

FIELD OF THE DISCLOSURE

The present invention generally relates to an abrasive article and a process for forming the abrasive article. More specifically, the present invention relates to an abrasive article including at least one abrasive component and a process of forming the same.

BACKGROUND

The construction industry utilizes a variety of tools for cutting and grinding of construction materials. Cutting and grinding tools are required to remove or refinish old sections of roads. Additionally, quarrying and preparing finishing materials, such as stone slabs used for floors and building facades, require tools for drilling, cutting, and polishing. Typically, these tools include abrasive segments bonded to a core, such as a plate or a wheel. Abrasive segments are typically formed individually and then bonded to the core by sintering, brazing, welding, and the like. Industry continues to look for improved formation of abrasive tools.

BRIEF DESCRIPTION OF THE DRAWINGS

The present disclosure may be better understood, and its numerous features and advantages made apparent to those skilled in the art by referencing the accompanying drawings.

Skilled artisans appreciate that elements in the figures are illustrated for simplicity and clarity and have not necessarily been drawn to scale. For example, the dimensions of some of the elements in the figures may be exaggerated relative to other elements to help to improve understanding of embodiments of the invention. The use of the same reference symbols in different drawings indicates similar or identical embodiments.

DETAILED DESCRIPTION

Embodiments can be drawn to abrasive articles including an abrasive component. An abrasive component can be an abrasive segment or a continuous rim. The abrasive component may be attached to a core. The abrasive articles can be suitable for material removing operations, such as grinding, drilling, cutting, the like, or any combination thereof. An example of the abrasive article can include segmented grinding wheels, segmented grinding rings, cut-off blades, drill bits, chop saws, or the like, or any combination thereof. The abrasive articles can have reduced contact surfaces with workpieces in material removing operations, and reduced friction between the abrasive articles and workpieces can allow better grinding performance and lower power consumption.

Further embodiments can be drawn to a process of forming the abrasive article. In an exemplary process, forming the abrasive article can include forming a green body of an abrasive component including an infiltrant material, a metal bond material, and abrasive particles. As used herein, green is intended to describe an article or a part of an article that is not finally formed. A green body of an abrasive component can be further treated, such as by heat, to form a finally formed abrasive component. The process can allow formation of the abrasive article having improved performance.

Figure 1:
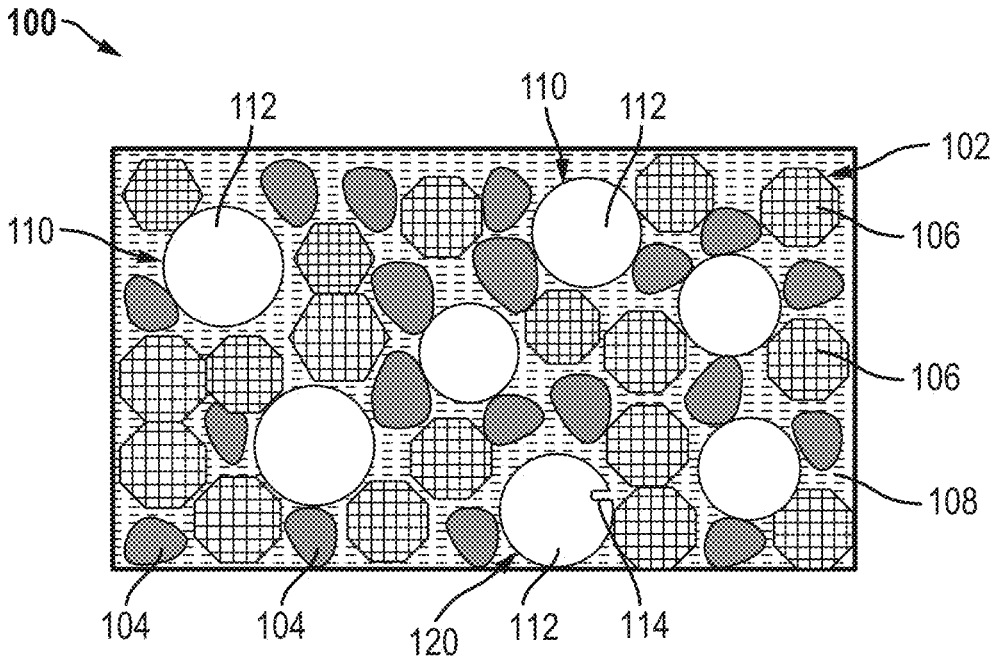
FIG. 1 includes an illustration of a cross section of an abrasive component according to an embodiment.

The abrasive article can include at least one abrasive component including a body. The body can include a bond matrix and abrasive particles contained within the bond matrix. FIG. 1 includes an illustration of a cross-sectional view of a body 100 of an exemplary abrasive component. The body 100 can include a bond matrix 102 including a bond material and abrasive particles 104. In an example, the bond material can include grains 106.

In an embodiment, the bond material can include a material that can facilitate improved formation and performance of the abrasive article. In an aspect, the bond material can include metal, such as an elemental metal, an alloy, or a combination thereof. In a particular aspect, the bond material can consist essentially of metal. In a particular example, the metal can include a transition metal element, a rare earth element, or any combination thereof. In a particular example, the metal can include iron, tungsten, cobalt, nickel, chromium, titanium, silver, cerium, lanthanum, neodymium, magnesium, aluminum, niobium, tantalum, vanadium, zirconium, molybdenum, palladium, platinum, gold, copper, cadmium, tin, indium, zinc, the like, an alloy thereof, or any combination thereof. In a particular aspect, the bond material can consist essentially of metal. For example, the bond material 106 can consist essentially of an alloy. The alloy can include any of the metal elements noted herein. A particular example of alloy can include an alloy including iron. In a more particular aspect, the bond material can consist essentially of an alloy including iron, such as an iron-based alloy.

In another aspect, the bond material can include grains 106 having an average grain size of up to 250 microns. For instance, the average grain size can be at least 8 microns, at least 9 microns, at least 10 microns, at least 20 microns, at least 40 microns, at least 60 microns, or at least 100 microns. In another instance, the average grain size can be at most 250 microns, at most 220 microns, at most 200 microns, at most 180 microns, at most 150 microns, or at most 100 microns. It is to be appreciated the average grain size of grains 106 can be in a range including any of the minimum and maximum values noted herein. In a particular aspect, the average grain size of grains 106 can be from 8 microns to 250 microns.

In a further aspect, the bond material 106 can include a certain melting temperature that can facilitate improved formation and performance of the abrasive article. In an instance, the melting temperature of the bond material can be at least 1200° C., at least 1220° C., at least 1250° C., or at least 1300° C. In another instance, the bond material 106 can have a melting temperature of at most 1700° C., at least 1600° C., or at most 1500° C. Additionally, or alternatively, the bond material can have a melting temperature in a range including any of the minimum and maximum values noted herein. For example, the bond material can have a melting temperature in a range from 1200° C. to 1700° C.

In an embodiment, the body 100 can include a certain content of the bond material that can facilitate improved formation and performance of an abrasive article. For instance, the content of the bond material can be at least 15 vol % for a total volume of the body, such as, at least 18 vol %, at least 20 vol %, at least 25 vol %, at least 27.5 vol %, at least 35 vol %, or at least 40 vol % for the total volume of the body. In another instance, the abrasive component body can include the content of the bond material of at most 75 vol % for a total volume of the body, such as at most 70 vol %, at most 65 vol %, at most 60 vol %, at most 55 vol %, at most 52 vol %, at most 48 vol %, or at least 40 vol % for the total volume of the body. It is to be understood that the body 100 can include the bond material in a content including the minimum and maximum percentages noted herein. For instance, the body 100 can include the bond material in a content in a range from 15 vol % to 75 vol % for the total volume of the body.

In another embodiment, the body can include abrasive particles 104 including a material that can facilitate improved performance of the abrasive article. In an aspect, the abrasive particles can include a carbide, nitride, oxide, boride, or any combination thereof. For example, the abrasive particles 104 can include aluminum oxide, titanium diboride, titanium nitride, tungsten carbide, titanium carbide, aluminum nitride, garnet, fused alumina-zirconia, sol-gel derived abrasive particles, diamond, silicon carbide, boron carbide, cubic boron nitride, or any combination thereof. In a particular aspect, the abrasive particles 104 can include a superabrasive particle including for example, diamond, cubic boron nitride (CBN), or any combination thereof. In a more particular aspect, the abrasive particles can consist essentially of the superabrasive particles. For example, the abrasive particles 104 can consist essentially of diamond, cubic boron nitride (cBN), or any combination thereof.

In another embodiment, the body 100 can include a certain content of abrasive particles that can facilitate improved formation of an abrasive article with improved performance. For instance, abrasive particles can be present in a content of at least 2 vol % for a total volume of the body, such as at least 8 vol %, at least 12 vol %, at least 18 vol %, at least 21 vol %, at least 27 vol %, at least 33 vol %, at least 37 vol %, or at least 42 vol %. In another example, abrasive particles can be present in a content of at most 50 vol %, such as at most 42 vol %, at most 38 vol %, at most 33 vol %, at most 28 vol %, or at most 25 vol %. Abrasive particles can be present in the body 100 in a content including any of the minimum and maximum percentages disclosed herein. For instance, abrasive particles can be in a content between 2 vol % to 50 vol % for the total volume of the body. After reading this disclosure, a skilled artisan would understand the content of abrasive particles may be determined depend on the application of the abrasive article. For example, an abrasive component of a grinding or polishing tool can include from 3.75 vol % to 50 vol % abrasive particles for the total volume of the body. In another example, an abrasive component of a cutting tool can include from 2 vol % to 6.25 vol % abrasive particles for the total volume of the body. Further, an abrasive component for core drilling may include from 6.25 vol % to 20 vol % abrasive particles for the total volume of the body.

In an embodiment, the abrasive component can include a body including an interconnected phase extending through at least a portion of the bond matrix. As illustrated in FIG. 1, the interconnected phase 108 can extend within the body 100. In an aspect, the interconnected phase 108 can extend two dimensionally through at least a portion of the bond matrix 102. In another aspect, the interconnected phase 108 can extend three dimensionally through at least a portion of the bond matrix 102. In another aspect, the interconnected phase 108 can extend throughout the bond matrix. In a particular aspect, the interconnected phase 108 can extend three dimensionally throughout the bond matrix.

The interconnected phase 108 can include a material that is different from the bond matrix. In an aspect, the melting temperature of the bond material 106 can be higher than a melting temperature of the interconnected phase 108. For example, the melting temperature of the bond material 106 can be at least 20° C. higher than a melting temperature of the interconnected phase 108, such as at least 50° C., at least 100° C., or at least 150° C. higher than the melting temperature of the interconnected phase. In another example, the melting temperature of the bond material 106 can be at most 350° C. higher than a melting temperature of the interconnected phase 108, such as at most 300° C., at most 250° C., or at most 200° C. higher than a melting temperature of the interconnected phase 108. Moreover, the melting temperature of the bond material 106 can be higher than the melting temperature of the interconnected phase 108, and the difference can be within a range including any of the minimum and maximum values noted herein. For instance, the difference can be in a range from 20° C. to 350° C.

In another aspect, the interconnected phase 108 can include a material having a certain melting temperature that can facilitate improved formation and performance of the abrasive article. In an instance, the interconnected phase 108 can include a material having a melting temperature of at most 1200° C., at most 1180° C., at most 1150° C., at most 1100° C., at most 1050° C., at most 1000° C., or at most 950° C. In another instance, the interconnected phase 108 can include a material having a melting temperature of at least 600° C., at least 630° C., at least 660° C., at least 700° C., at least 750° C., at least 800° C., at least 850° C., at least 900° C., at least 950° C., at least 1000° C., at least 1050° C., at least 1100° C., at least 1150° C., or at least 1180° C. Moreover, the interconnected phase 108 can include a material having a melting temperature in a range including any of the minimum and maximum values noted herein. For instance, the interconnected phase 108 can include a material having a melting temperature in a range from 850° C. to 1200° C., or in a range from 900° C. to 1180° C.

In another aspect, the interconnected phase 108 can include a certain metal material that can facilitate improved formation and performance of the abrasive article. For example, the interconnected phase 108 can include a different metal element than the bond material. In another example, the metal can include copper, tin, zinc, an alloy thereof, or any combination thereof. In particular instances, the interconnected phase 108 can include copper or an alloy including copper. In a more particular instance, the interconnected phase 108 can consist essentially of copper, an alloy including copper, or a combination thereof. In a particular aspect, the interconnected phase 108 can consist essentially of copper, bronze, brass, the like, or any combination thereof.

In a further embodiment, the body can include a certain content of the interconnected phase that can facilitate improved formation and performance of the abrasive article. In an aspect, the body can include at least 10 vol % of the interconnected phase for a total volume of the body, such as at least 15 vol %, such as at least 18 vol %, at least 20 vol %, at least 23 vol %, at least 27 vol %, at least 30 vol %, at least 35 vol %, or at least 40 vol % of the interconnected phase for a total volume of the body. In another aspect, the body can include at most 80 vol %, at most 75 vol %, at most 70 vol %, at most 60 vol %, at most 55 vol %, at most 50 vol %, at most 45 vol % of the interconnected phase for the total volume of the body, such as at most 40 vol %, at most 35 vol %, at most 31 vol %, at most 29 vol %, at most 25 vol %, or at most 21 vol % of the interconnected phase for a total volume of the body. Moreover, the body can include a content of the interconnected phase in a range including any of the minimum and maximum percentages noted herein. For example, the body 100 can include a content of the interconnected phase in a range from 10% to 45 vol % of the total volume of the body, such as in a range from 15 vol % to 40 vol %.

In a further aspect, the body can include a particular weight content of the interconnected phase. For instance, the body can include at least 15 wt. % of the interconnected phase for a total weight of the body, such as at least 20 wt. %, at least 22 wt. %, at least 25 wt. %, at least 28 wt. %, or at least 30 wt. % for the total weight of the body. In another instance, the body can include at most 80 wt. %, at most 75 wt. %, at most 70 wt. %, at most 65 wt. %, at most 60 wt. %, at most 55 wt. %, at most 50 wt. % of the interconnected phase, such as at most 45 wt. %, at most 40 wt. %, or at most 35 wt. % for a total weight of the body. It is to be appreciated that the content of the interconnected phase can be in a range including any of the minimum and maximum percentages noted herein. For example, the body can include the interconnected phase in a range from 15 wt. % to 50 wt. % or in a range from 20 wt. % to 45 wt. % or in a range from 25 wt. % to 40 wt. % or in a range from 30 wt. % to 35 wt. % of the total weight of the body.

In another embodiment, the body 100 can include a controlled porosity, e.g., a certain average pore size, a certain content of pores, or any combination thereof. In an aspect, the body can include pores having a relatively large average size that can facilitate improved formation and performance of the abrasive article. In an aspect, the body 100 can include macroscopic pores. For example, the body 100 can include macroscopic pores having an average pore size of at least 200 microns, at least 250 microns, at least 300 microns, at least 330 microns, at least 360 microns, at least 400 microns, at least 450 microns, at least 470 microns, at least 510 microns, at least 560 microns, at least 600 microns, or at least 630 microns. In another example, the body can have include macroscopic pores having an average size of at most 1.5 mm, at most 1.2 mm, at most 1 mm, at most 900 microns, at most 800 microns, at most 710 microns, at most 700 microns, at most 670 microns, at most 620 microns, at most 580 microns, at most 520 microns, at most 480 microns, at most 430 microns, at most 390 microns, at most 330 microns, or at most 300 microns. In a further instance, the body can including macroscopic pores having an average pore size in a range including any of the minimum and maximum values noted herein. For example, the average pore size can be in a range from 200 microns to 1.5 mm, or in a range from 200 microns to 710 microns, or in a range from 400 microns to 700 microns. In this disclosure, pores having relatively large average size as noted in embodiments herein, are referred to as macroscopic pores. In at least one aspect, the body may include a particular porosity consisting essentially of the macroscopic pores. For instance, the porosity of the body may consist essentially of the macroscopic pores. In another instance, the body may include at most 10 vol % of smaller pores for the total volume of the body, such as at most 8 vol %, at most 5 vol %, at most 2 vol %, or at most 1 vol %. The smaller pores are intended to refer to pores having average sizes less than 200 microns, such as at most 150 microns, at most 100 microns, or at most 50 microns. In a particular instance, the body may be essentially free of pores having an average size of less than 200 microns, at most 150 microns, at most 100 microns, or at most 50 microns.

In an aspect, the body 100 can include a certain content of pores that can facilitate improved performance of the abrasive article. For example, the body 100 can include a porosity of at least 10 vol %, at least 12 vol %, such as at least 15 vol %, at least 18 vol %, at least 20 vol %, at least 23 vol %, at least 27 vol %, or at least 30 vol % for a total volume of the body. In another example, the body 100 can include a porosity of at most 60 vol %, such as at most 50 vol %, at most 40 vol % for a total volume of the body, at most 35 vol %, at most 31 vol %, at most 29 vol %, at most 25 vol %, or at most 21 vol % for a total volume of the body. Moreover, the body can include a porosity in a range including any of the minimum and maximum percentages noted herein. For example, the body 100 can include a porosity in a range from 10 vol % to 60 vol % of the total volume of the body or in a range from 12% to 40 vol % of the total volume of the body or in a range from 15 vol % to 35 vol % of the total volume of the body.

In an embodiment, the body 100 can include a discontinuous phase including a plurality of discrete members 110 contained in the bond matrix 102. The discontinuous phase can be distinct from the interconnected phase 108, the bond matrix 102, and the abrasive particles 104.

In an aspect, the discontinuous phase can include macroscopic pores. For instance, at least some of the discrete members 110 can each include a macroscopic pore 112. In a particular instance, a majority of the discrete members 110 can each include a macroscopic pore 112. In a more particular instance, each of the discrete members 110 can include a macroscopic pore 112. In another particular instance, each of a majority of the discrete members 110 can consist of a macroscopic pore 112. In another more particular instance, each of the discrete members 110 can consist of a macroscopic pore 112.

In some instances, the discontinuous phase can include a discrete member 120 including a residue 114 of the interconnected phase. The residue 114 and interconnected phase 108 can include the same material. In an instance, the residue 114 may be connected to the interconnected phase 108. In a further instance, the discontinuous phase can include a plurality of discrete members each including a macroscopic pore, wherein at least one of the discrete member can include a residue of the interconnected phase. In certain instances, the discontinuous phase may include a plurality of discrete members 120 each including a residue 114 of the interconnected phase and a macroscopic pore 112.

In another aspect, a discrete member 110 or 120 can include a macroscopic pore 112 that can be connected to the interconnected phase 108. For example, a discrete member 110 can include a macroscopic pore 112 that is defined by the interconnected phase. In another example, a macroscopic pore 112 can be connected to the interconnected phase and connected to at least one of the bond matrix 102 and abrasive particles 104. In an example, a discrete member 110 can include a macroscopic pore 112 that is defined by the interconnected phase 108 and at least one of the bond matrix 102 and abrasive particles 104.

In a particular aspect, the discontinuous phase can consist essentially of macroscopic pores, macroscopic pores containing a residue of the interconnected phase, or a combination thereof.

Figure 2:
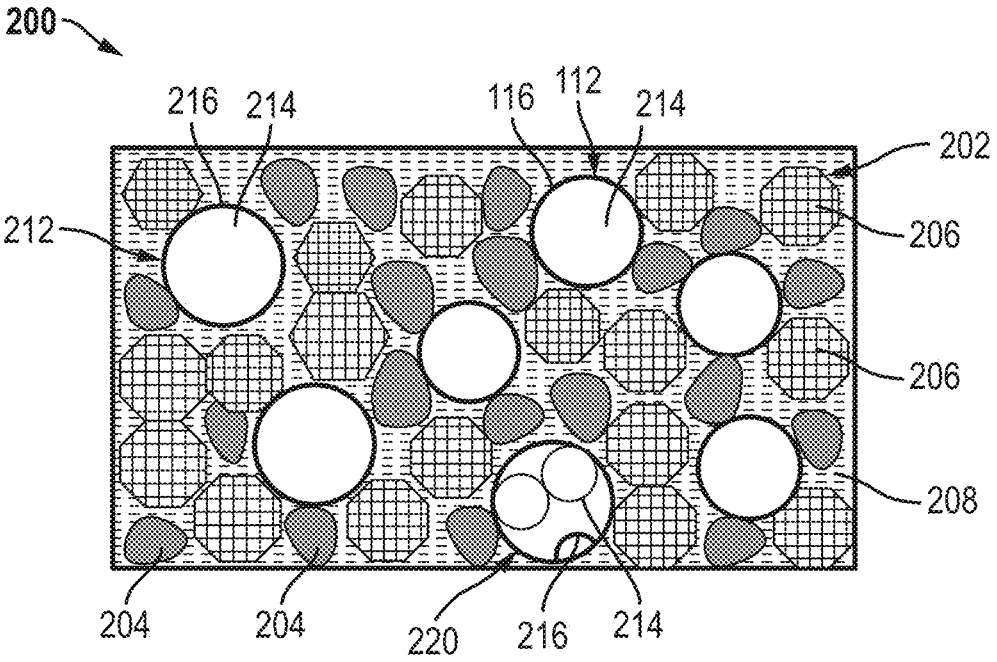
FIG. 2 includes an illustration of a cross section of another abrasive component according to an embodiment.

FIG. 2 includes an illustration of a cross section of a body 200 of an abrasive component according to an embodiment. The body 200 can include a bond matrix 202 and abrasive particles 204 contained within the bond matrix 202. The interconnected phase 208 can extend through at least a portion of the bond matrix 202.

The body 200 can include a discontinuous phase including a plurality of discrete members 212 each including a macroscopic pore 214. The macroscopic pore 214 can be defined by a material 216. In an aspect, the material 216 can be different from the bond material 206, the interconnected phase 208, or both. For instance, the material 216 can have a melting temperature higher than the melting temperature of the bond material 206, the melting temperature of the interconnected phase 208, or both. In another instance, the material 216 can include a ceramic material. An exemplary ceramic material can include an oxide, a carbide, a boride, the like, or a combination thereof. A particular oxide can include alumina.

As illustrated, discrete members 212 include macroscopic pores that are fully defined by the material 216. In some instances, the discontinuous phase can include a discrete member 220 including a macroscopic pore 214 that is partially defined by the material 216. In certain instance, a discrete member 220 can include a macroscopic pore 214 and a portion of the material 216 contained in the macroscopic pore 214.

In an embodiment, a discontinuous phase can consist of discrete members each including a macroscopic pore, such as discrete members 110, 120, 212, 220, or any combination thereof. In a further embodiment, the body 100 can include a discontinuous phase consisting of discrete members each including a macroscopic pore connected to the interconnected phase. In a particular embodiment, the discontinuous phase can consist of discrete members, wherein the discrete members can consist of macroscopic pores that are connected to the interconnected phase. In a particular instance, the discontinuous phase can consist of discrete members 110, 120, or any combination. In a further embodiment, a discontinuous phase can consist of discrete members, wherein each discrete member can include a macroscopic pore at least partially defined by a material that is different from the interconnected phase, the bond matrix, or both. In a particular example, a discontinuous phase can consist of discrete members 212, 220, or a combination thereof.

In an embodiment, the body can include a filler. In an aspect, the filler can include isolated particles contained in the bond matrix. In some instances, the filler can be separated from the interconnected phase. In an aspect, the filler can include a material different than at least one of the bond matrix, the interconnected phase, and the discontinuous phase. In a particular aspect, the filler can include a different material than the discontinuous phase. In a further aspect, the filler can include an inorganic material. A particular example of filler can include an oxide, a carbide, a nitride, a boride, or any combination thereof. A more particular example of filler can include graphite, tungsten carbide, boron nitride, tungsten disulfide, silicon carbide, aluminum oxide, alumina silica, or any combination thereof.

In a further aspect, the filler can have an average particle size of at most 2000 microns, such as at most 1800 microns, at most 1500 microns, at most 1200 microns, at most 1000 microns, at most 800 microns, at most 600 microns, at most 500 microns, at most 400 microns, at most 300 microns, at most 200 microns, at most 150 microns, at most 120 microns, at most 100 microns, or at most 80 microns. In another aspect, the filler can have an average particle size of at least 60 microns, such as at least 65 microns, at least 70 microns, at least 75 microns, at least 80 microns, at least 90 microns, or at least 100 microns. Moreover, the filler can have an average particle size in a range including any of the minimum and maximum values noted herein. In certain instances, a filler with a relatively large particle size, such as alumina silica, can be used. For instance, certain filler can have an average size of a few millimeters, such as at least 1 mm or at least 2 mm.

In an embodiment, the body can include a certain content of the filler that can facilitate improved performance of the abrasive article. In an aspect, the body can include at least 5 vol % of filler for a total volume of the body, such as at least 7 vol %, at least 10 vol %, at least 12 vol %, at least 15 vol %, or at least 20 vol % of filler for a total volume of the body. In another aspect, the body can include at most 30 vol % of filler for a total volume of the body, such as at most 25 vol %, at most 20 vol %, or at most 17 vol % of filler for a total volume of the body. Moreover, the body can include filler in a content including any of the minimum and maximum percentages noted herein.

Figure 3:
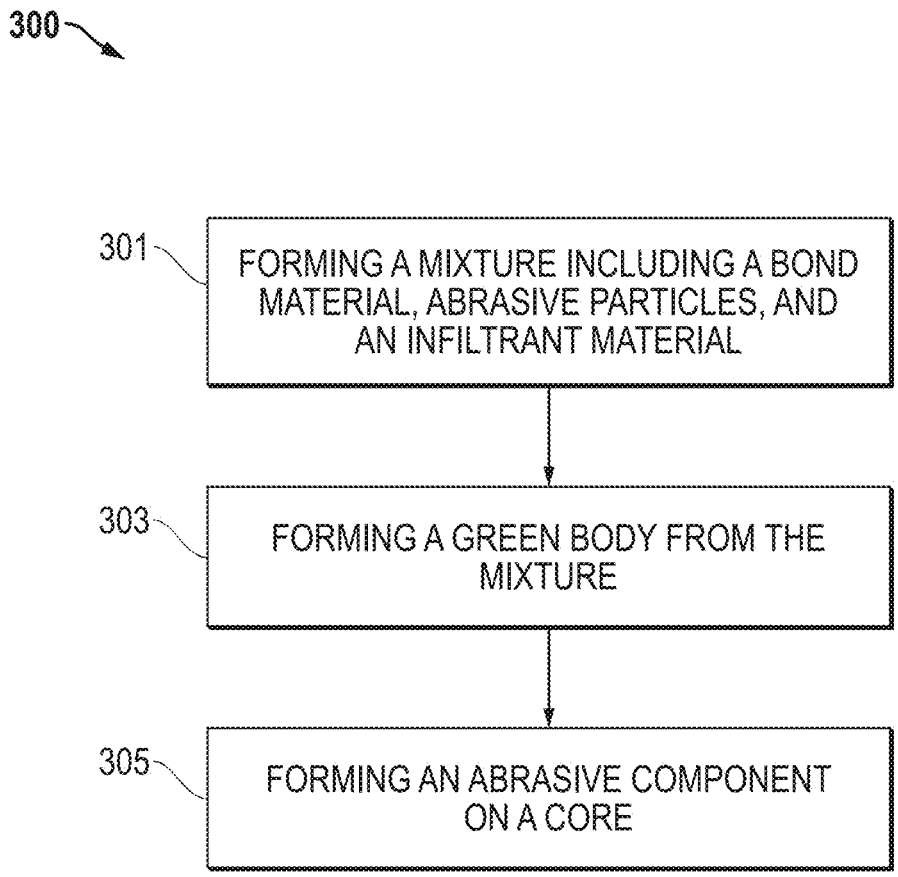
FIG. 3 includes a flow chart including a process in accordance with an embodiment.

FIG. 3 includes a flow chart illustrating an exemplary process 300 for forming the abrasive article. The process 300 can start at block 301, forming a mixture including a bond material, abrasive particles, and an infiltrant material. The mixture can include any of the bond material and abrasive particles noted in embodiments in this disclosure. In some implementations, the bond material can include a wear resistant component, such as tungsten carbide. The bond material can be in the form of powder. For instance, the bond material can include a blend of particles of individual components or pre-alloyed particles.

In an embodiment, the mixture can include a certain content of the bond material that can facilitate improved formation and performance of the abrasive article. In an aspect, the mixture can include at least 15 wt. % of the bond material for a total weight of the mixture, such as at least 20 wt. %, at least 25 wt. %, at least 28 wt. %, at least 30 wt. %, at least 33 wt. %, at least 35 wt. %, at least 38 wt. %, at least 40 wt. %, at least 42 wt. %, at least 45 wt. %, or at least 46 wt. %. In another example, the mixture can include at most 90 wt. % of the bond material for a total weight of the mixture, such at most 80 wt. %, at most 75 wt. %, at most 70 wt. %, at most 65 wt. %, at most 60 wt. %, at most 55 wt. % at most 50 wt. %, at most 48 wt. %, or at most 46 wt. %. In a further example, the mixture can include at least 15 wt. % and at most 90 wt. % of the bond material for a total weight of the mixture.

The mixture can include any of abrasive particles noted in embodiments in this disclosure. In an embodiment, the abrasive particles can have an average particle size that can facilitate improved formation and performance of the abrasive article. For example, the average particle size can be at least 30 microns, such as at least 35 microns, at least 40 microns, at least 45 microns, at least 50 microns, at least 55 microns, at least 60 microns, at least 70 microns, at least 80 microns, at least 85 microns, at least 95 microns, at least 100 microns, at least 125 microns, at least 140 microns, or at least 180 microns. In another example, the abrasive particles can have an average particle size of at most 900 microns, such as at most 860 microns, at most 750 microns, at most 700 microns, at most 620 microns, at most 500 microns, at most 450 microns, at most 400 microns, at most 350 microns, at most 280 microns, or at most 250 microns. It is to be appreciated that the abrasive particles can have an average particle size within a range including any of the minimum and maximum values disclosed herein. For instance, the average particle size of the abrasive particles can be within a range including at least 30 microns and at most 900 microns. Abrasive particle size can be selected to suit applications of the abrasive article. For example, coarse abrasive particles may be desired for certain applications requiring abrasive particles including diamond.

In an embodiment, the mixture can include abrasive particles in a content that can facilitate improved formation and performance of an abrasive article. For example, the mixture can include at least 5 wt. % of abrasive particles for a total weight of the mixture, such as at least 8 wt. %, at least 10 wt. %, at least 12 wt. %, at least 15 wt. %, at least 18 wt. %, at least 20 wt. %, at least 22 wt. %, at least 25 wt. %, at least 28 wt. %, at least 20 wt. %, or at least 33 wt. %. In another example, the mixture can include at most 55 wt. % of abrasive particles for a total weight of the mixture, such as at most 49 wt. %, at most 41 wt. %, at most 38 wt. %, or at most 35 wt. %. In a further embodiment, the mixture can include at least 5 wt. % and at most 55 wt. % of abrasive particles for a total weight of the mixture.

In an embodiment, the mixture can include an infiltrant material including a solid material. In an aspect, the infiltrant material can be in the form of macroscopic particles including solid particles, hollow particles, particles having holes, or any combination thereof. In a particular aspect, the macroscopic particles can consist essentially of hollow particles. In another aspect, the infiltrant material can include a certain average particle size that can facilitate improved formation and performance of the abrasive article. In a particular aspect, the infiltrant microscopic particles can have a particular average particle size that can allow the particles to have sufficient rigidity to survive the forming process of the body. In another particular aspect, the particular average size may facilitate formation of desired shape and structure of the green body and allow controlled formation of the green body with improved strength and interconnected porosity. For example, the macroscopic particles can include an average size of at least 200 microns, at least 300 microns, at least 330 microns, at least 360 microns, at least 400 microns, at least 450 microns, at least 470 microns, at least 510 microns, at least 560 microns, at least 600 microns, at least 630 microns, at least 660 microns, or at least 710 microns. In another instance, the macroscopic particles can include an average size of at most 1.5 mm, at most 1.2 mm, at most 1 mm, at most 800 microns, at most 900 microns, at most 750 microns, at most 710 microns, at most 670 microns, at most 620 microns, at most 580 microns, at most 520 microns, at most 480 microns, at most 430 microns, at most 390 microns, or at most 330 microns. In a particular instance, the macroscopic particles can include an average size in a range including any of the minimum and maximum values noted herein. For example, the macroscopic particles can include an average size in a range from 300 microns to 750 microns.

In a further aspect, the infiltrant material can be different from the bond material. For instance, the infiltrant material can have a melting temperature lower than the melting temperature different of the bond material. In another instance, the infiltrant material can have a melting temperature of at most 1200° C., at most 1180° C., at most 1150° C., at most 1100° C., at most 1050° C., at most 1000° C., or at most 950° C. In still another instance, the infiltrant material can have a melting temperature of at least 600° C., at least 650° C., at least 700° C., at least 750° C., at least 800° C., at least 850° C., at least 900° C., at least 950° C., at least 1000° C., at least 1050° C., at least 1100° C., at least 1150° C., or at least 1180° C. Moreover, the infiltrant material can have a melting temperature in a range including any of the minimum and maximum values noted herein.

In an aspect, the infiltrant material can include an inorganic material, such as a metal. In particular instances, the infiltrant material can consist essentially of metal. An example of the metal can include copper, tin, zinc, an alloy thereof, or a combination thereof. In a particular aspect, the infiltrant material can include an alloy, such as an alloy including copper. In a more particular aspect, the infiltrant material can include bronze, brass, copper, or any combination thereof. In an even more particular aspect, the infiltrant material can consist of bronze, brass, copper, or any combination thereof. In some instances, the infiltrant material can further include titanium, silver, manganese, phosphorus, aluminum, magnesium, or any combination thereof.

In an embodiment, the mixture can include the infiltrant material in a content that can facilitate improved formation and performance of an abrasive article. For example, the mixture can include at least 5 wt. % of the infiltrant material for a total weight of the mixture, such as at least 8 wt. %, at least 10 wt. %, at least 12 wt. %, or at least 15 wt. In another example, the mixture can include at most 30 wt. % of the infiltrant material for a total weight of the mixture, such as at most 25 wt. %, at most 22 wt. %, at most 20 wt. %, or at most 18 wt. %. In a further embodiment, the mixture can include at least 5 wt. % and at most 25 wt. % of infiltrant material for a total weight of the mixture.

The mixture can optionally include any filler noted in embodiments of this disclosure. Filler can be added to modify a property of the finally formed abrasive article or facilitate a forming process. For example, filler including silica gel, SiC, $Al_2O_3$, or the like can be added to improve wear resistance of the abrasive tool. Filler can be in the form of powder, granules, particles, or a combination thereof. Filler may or may not be present in the finally-formed abrasive article.

In an embodiment, the mixture can include filler in a content that can facilitate improved formation and performance of an abrasive article. For instance, filler can have a content of at least 0.5 wt. % for the total weight of the mixture, such as at least 1.5 wt. %, at least 2.5 wt. %, or at least 4 wt. %. In another instance, filler can have a content of at most 12 wt. % for the total weight of the mixture, such as at most 11 wt. %, at most 9 wt. %, or at most 7.5 wt. %. In a further embodiment, the content of filler can be in a range including any of the minimum or maximum percentages noted herein. For instance, the mixture can include a filler content of at least 0.5 wt. % and at most 12 wt. %.

The process 300 can continue to form a green body from the mixture at block 303. In an aspect, forming the green body can include shaping the mixture. In an exemplary implementation, the mixture can be disposed into a shaping device, such as a mold, capable of providing a desired shape. For instance, the mold can provide a shape of an abrasive segment or a continuous rim. In some instances, the mold can include a plurality of regions to facilitate shaping and forming a plurality of green bodies.

In a further aspect, forming a green body can include applying pressure to the mixture. For example, the mixture can be pressed, such as by cold pressing, to form the green body including the bond material, abrasive particles, and the infiltrant material. In an exemplary implementation, cold pressing can be carried out at a pressure from 100 MPa to 2500 MPa. In another aspect, the green body can be porous. In a particular aspect, the green body can have a network of interconnected pores. In another particular aspect, the green body can have an interconnected porosity from 10 vol % to 35 vol % for the total volume of the green body.

The process 300 can continue to block 305, forming an abrasive component on a core. In an embodiment, the process 300 can include forming a finally-formed body of an abrasive component. In an aspect, a heat can be applied to at least a portion of the green body to facilitate formation of a finally-formed body. For instance, the entire green body can be heated for forming a finally-formed body. In an aspect, heating can include infiltrating at least a portion of the green body. For instance, heating can be performed at a temperature higher than a melting temperature of the infiltrant material and lower than a melting temperature of the bond material. In a further instance, heating can be conducted such that the infiltrant material within the green body can melt and form a liquid to infiltrate at least a portion of the green body, such as by capillary action. In an exemplary implementation, the green body can be heated to melt the infiltrant material within the green body, and the liquid infiltrant material can flow into the network of the interconnected pores to form the interconnected phase. In a particular aspect, at least 96%, at least 98%, at least 99%, or all of the interconnected porosity can be filled by the infiltrant material within the green body. In another particular aspect, heating can be performed such that the interconnected phase can be formed from the infiltrant material. In a further aspect, macroscopic pores can be formed when the liquid infiltrant material is drawn into the network of the interconnected pores.

In another aspect, infiltrating can be facilitated by using an additional infiltrant material. For example, an additional infiltrant material may be used when the green body includes a lower content of infiltrant macroscopic particles compared to the porosity of the green body. For example, an infiltrant slug can be disposed on a surface of the green body prior to applying heat to the green body. The infiltrant slug can include copper, bronze such as a copper-tin bronze, brass, a copper-tin-zinc alloy, or any combination thereof. In particular instances, the infiltrant slug can include the same composition as the infiltrant macroscopic particles within the green body. The infiltrant slug can be formed by cold pressing a powder of the additional infiltrant material. The powder can include particles of individual components or pre-alloyed particles. Alternatively, the infiltrant slug may be formed by other metallurgical techniques known in the art. In a further aspect, heating can be performed to melt the infiltrant material within the green body and the infiltrant slug to infiltrate the green body. For example, at least 96%, at least 98%, at least 99%, or all of the interconnected porosity can be filled to form the interconnected phase by the infiltration process.

In another aspect, heating can include sintering the green body. In a particular aspect, heating can include sintering and infiltrating, and more particularly, sintering can be performed simultaneously with infiltrating.

In another aspect, heating can be conducted at a certain temperature to facilitate improved formation and performance of the abrasive article. In an instance, heating can be performed at a temperature at least 900° C., at least 950° C., at least 1000° C., at least 1050° C., at least 1100° C., at least 1150° C., or at least 1180° C. In a further instance, heating can be performed at a temperature at most 1200° C., at most 1180° C., at most 1150° C., at most 1100° C., at most 1050° C., at most 1000° C., or at most 950° C. Moreover, heating can be conducted at a temperature in a range including any of the minimum and maximum values noted herein.

In an aspect, heating can be conducted in a reducing atmosphere. Typically, the reducing atmosphere can contain an amount of hydrogen to react with oxygen. The heating can be carried out in a furnace, such as a batch furnace or a tunnel furnace.

In an embodiment, a finally-formed body of an abrasive component can be attached to a core. In an aspect, the body can be finally formed after heating, such as sintering and infiltrating the green body. In another aspect, a plurality of finally-formed body can be attached to a core.

In a further aspect, attaching the finally formed body to a core can be conducted by using, for example, welding, brazing, a laser, electron beam, or any combination thereof, such that one or more abrasive component bodies can be bonded to the core. In implementations, the body may be joined to a backing and attached to the core via the backing. For example, the body can be bonded to the backing by the infiltrant material. An exemplary backing can include an iron-based material. A particular example of the backing can include steel. In an exemplary implementation, the green body can be placed abut a backing, and by application of heat, the melted infiltrant material may fill the interconnected pores in the green body and the gap between the body and the backing. In instances, the backing may include pores and can be densified by the infiltrant material to further facilitate attachment to the core. In a particular instance, the interconnected phase of the body may extend into the backing. Accordingly, porosity of the backing may be taken into consideration for including a suitable amount of the infiltrant macroscopic particles in the green body in applications a denser backing is desired. In further instances, an additional infiltrant material other than macroscopic particles, as described in subsequent paragraphs, may be added to facilitate joining the body to the backing and/or joining the backing to the core. Depending on the application, a core can be in the form of a ring, a ring section, a plate, a cup wheel body, or a disc, such as a solid metal disk. A core can include heat treatable steel alloys, such as 25CrMo4, 75Crl, C60, steel 65Mn, or similar steel alloys for cores with thin cross sections or simple construction steel like St 60 or similar for thick cores. A suitable core can be formed by a variety of metallurgical techniques known in the art.

In another embodiment, attaching the body to a core can be performed simultaneously with forming a finally formed abrasive component body. In an aspect, one or more green bodies can be placed adjacent a core, such as abutting the core. Heating can be conducted as described in embodiments herein. For example, the green body can be infiltrated and/or sintered by heating. In particular instances, a portion of the infiltrant material may remain between the core and the one or more abrasive component bodies such that a bonding region consisting essentially of the infiltrant material can be formed between the core and the one or more bodies. The bonding region can be an identifiable region distinct from the core and the abrasive component. The bonding region can include at least about 90 wt. % infiltrant material, such as at least about 95 wt. % bonding metal, such as at least about 98 wt. % infiltrant material. The infiltrant material can be continuous throughout the bonding region and the one or more finally-formed bodies. In some instances, an additional infiltrant material, such as an infiltrant slug, or another material including bronze, or the like, can be disposed in contact with at least one of the core and a green body to facilitate formation of one or more abrasive components on a core. In other instances, attaching the body to a core can be performed using methods known in the art. For instance, US Publication No. 2010/0035530 A1 discloses processes of attaching abrasive components to a core and is incorporated herein in its entirety.

In another embodiment, forming a green body and attaching the green body to a core can be performed simultaneously. In an exemplary implementation, a core can be placed in contact with the mixture in a mold. A pressure can be applied to the mixture to facilitate forming and joining the green body of the abrasive component to the core. In another instance, a plurality of green bodies can be formed and jointed to the core by application of pressure. In a particular implementation, forming one or more green bodies on a core can include a single operation of pressing, such as cold pressing. In another instance, hot pressing, isostatic pressing, or the like can be performed to form one or more green bodies joined to the core. Heat can be applied to at least a portion of the one or more green bodies to facilitate infiltration and/or sintering to form one or more finally formed bodies. Particularly, a portion of the infiltrant material can form a bonding region between the core and one or more finally-formed bodies such that bonding of one or more finally formed bodies to the core can be conducted simultaneously with heating. In some instances, an infiltration slug may be used to facilitate infiltration of one or more green bodies and/or bonding of one or more finally-formed bodies to the core.

Figure 4:
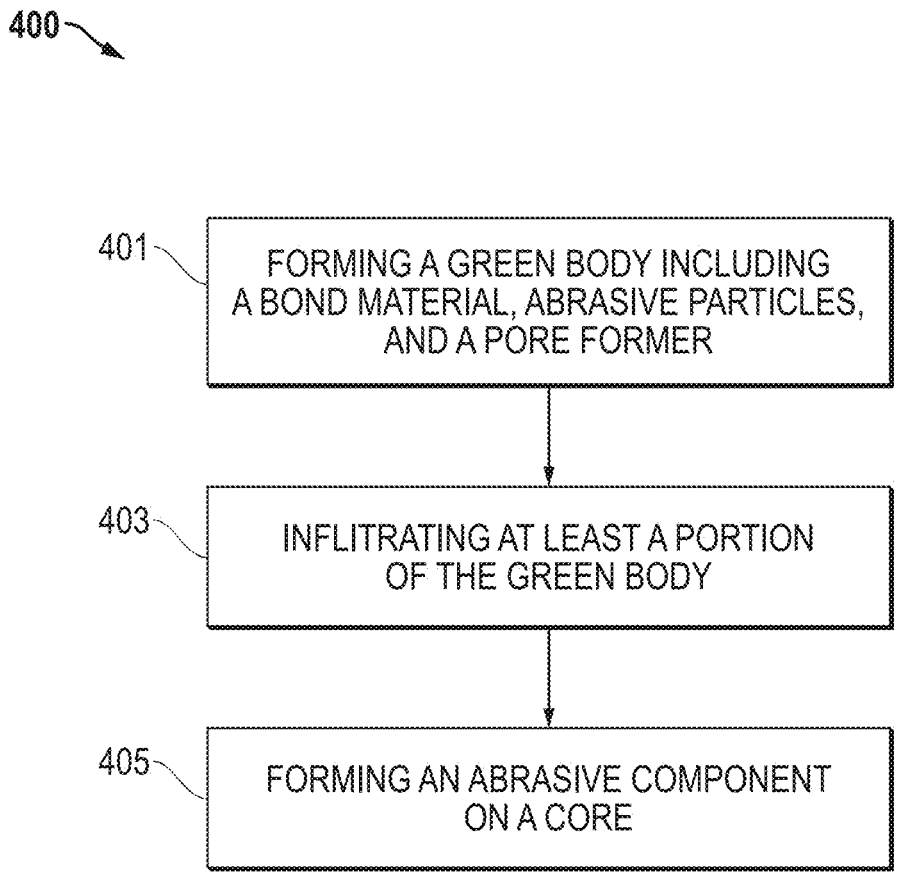
FIG. 4 includes a flow chart including another process in accordance with an embodiment.

FIG. 4 includes a flow chart illustrating another exemplary process 400 for forming the abrasive article. The process 400 can start at block 401, forming a green body including a bond material, abrasive particles and a pore former. The green body can optionally include a filler. The green body can be formed as described in embodiments with respect to the process 300 from a mixture including the same composition as the green body. The green body can have an interconnected porosity, such as from 10 vol % to 35 vol % for the total volume of the green body.

In an aspect, the pore former can include microscopic particles that are different from abrasive particles in composition, particle size, or any combination thereof. In another aspect, the pore former can include a material different from the bond material. For instance, the pore former can include a material having a higher melting temperature than the bond material. In another instance, the pore former can include a ceramic material, such as an oxide, carbide, boride, the like, or any combination thereof. A particular example of oxide can include alumina. In another aspect, the pore former can include, or in particular instances, consist essentially of hollow macroscopic particles including a ceramic material.

In an aspect, the pore former can include an average particle size that can facilitate improved formation and performance of the abrasive article. For example, the pore former can have an average particle size of at least 150 microns, at least 200 microns, at least 250 microns, at least 300 microns, at least 330 microns, at least 360 microns, at least 400 microns, at least 450 microns, at least 470 microns, at least 510 microns, at least 560 microns, at least 600 microns, at least 630 microns, at least 660 microns, at least 710 microns, at least 750 microns, at least 780 microns, or at least 800 microns. In another instance, the pore former can have an average particle size of at most 900 microns, such as at most 850 microns, at most 800 microns, at most 750 microns, at most 710 microns, at most 670 microns, at most 620 microns, at most 580 microns, at most 520 microns, at most 480 microns, at most 430 microns, at most 390 microns, or at most 330 microns. Moreover, the pore former can have an average particle size in a range including any of the minimum and maximum values noted herein.

In an embodiment, the green body can include a certain content of the pore former that can facilitate improved formation and performance of the abrasive article. For example, the mixture can include at least 5 wt. % of the pore former for the total weight of the green body, such as at least 8 wt. %, at least 10 wt. %, at least 12 wt. %, at least 15 wt. %, at least 18 wt. %, at least 20 wt. %, at least 22 wt. %, at least 25 wt. %, at least 28 wt. %, at least 20 wt. %, or at least 33 wt. %. In another example, the green body can include at most 35 wt. % of the pore former for a total weight of the green body, such as at most 30 wt. %, at most 28 wt. %, at most 25 wt. %, at most 20 wt. %, at most 18 wt. %, or at most 15 wt. %. In a further embodiment, the green body can include at least 5 wt. % and at most 35 wt. % of pore formers for a total weight of the green body.

In a further aspect, forming a green body and joining the green body to a core can be performed simultaneously as described in embodiments related to the process 300.

In an embodiment, the process 400 can include heating at least a portion of the green body. In an aspect, heating can include infiltrating at least a portion of the green body, as illustrated at block 403. In an exemplary implementation, infiltrating can include applying an infiltrant material to a portion of the green body. For instance, an infiltrant slug as described in embodiments herein can be disposed over a surface of the green body. Heating can be conducted to melt the infiltrant material to infiltrate the green body. In an exemplary infiltrating process, at least 96%, at least 98%, at least 99%, or all of the interconnected pores can be filled with the infiltrant material. In another aspect, heating can include sintering the green body. In a particular aspect, heating can be conducted to infiltrate and sinter the green body simultaneously.

The process 400 can include forming an abrasive component on a core at block 405. In an aspect, one or more finally-formed abrasive component bodies can be attached to a core as described in embodiments related to the process 300, such as by welding, brazing, or using a laser.

In another aspect, attaching one or more abrasive bodies to a core can be performed simultaneously with infiltrating. In an instance, one or more green abrasive component bodies may be joined to the core when one or more green bodies are formed. Alternatively, one or more green bodies can be placed adjacent a core, such as abutting the core. An infiltrant material can be placed in contact with the core and/or one or more green bodies. In some instances, an infiltrant material can be placed between one or more green bodies and the core. Heating can be conducted to melt the infiltrant material to infiltrate one or more green bodies, and a portion of the infiltrant material may remain between the core and one or more bodies forming a bonding region as described in embodiments related to the process 300.

In another embodiment, a mixture can be formed including a bond material, abrasive particles, a pore former, and an infiltrant material. The mixture can be formed into one or more green bodies as described in embodiments herein. The green bodies can be heated, such as infiltrated and sintered, and bonded to a core as described in embodiments herein.

Figure 5:
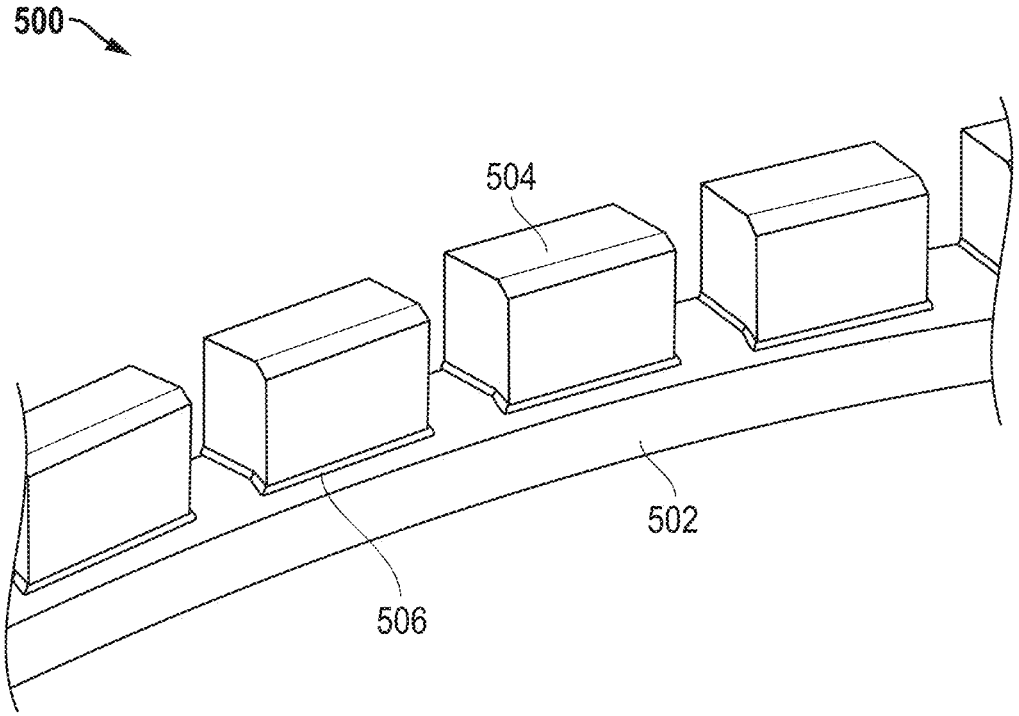
FIG. 5 includes an illustration of a portion of an exemplary abrasive article in accordance with an embodiment.
Figure 6:
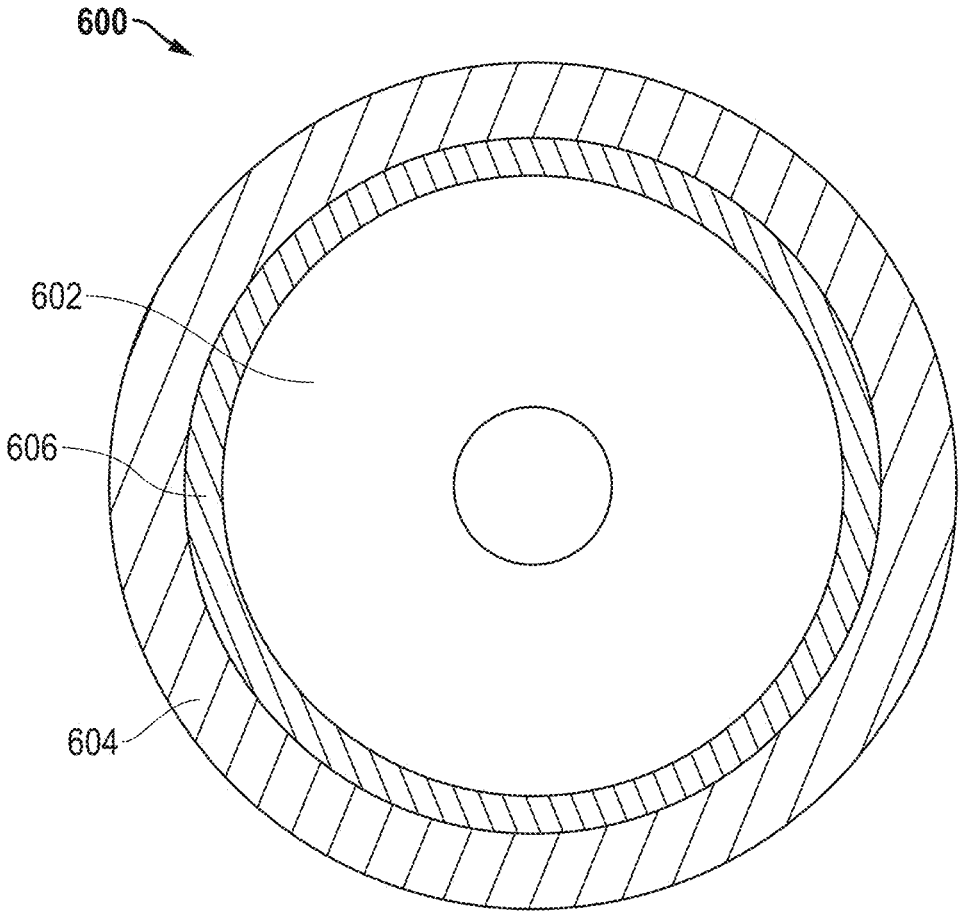
FIG. 6 includes an illustration of an exemplary abrasive article in accordance with another embodiment herein.
Figure 7:
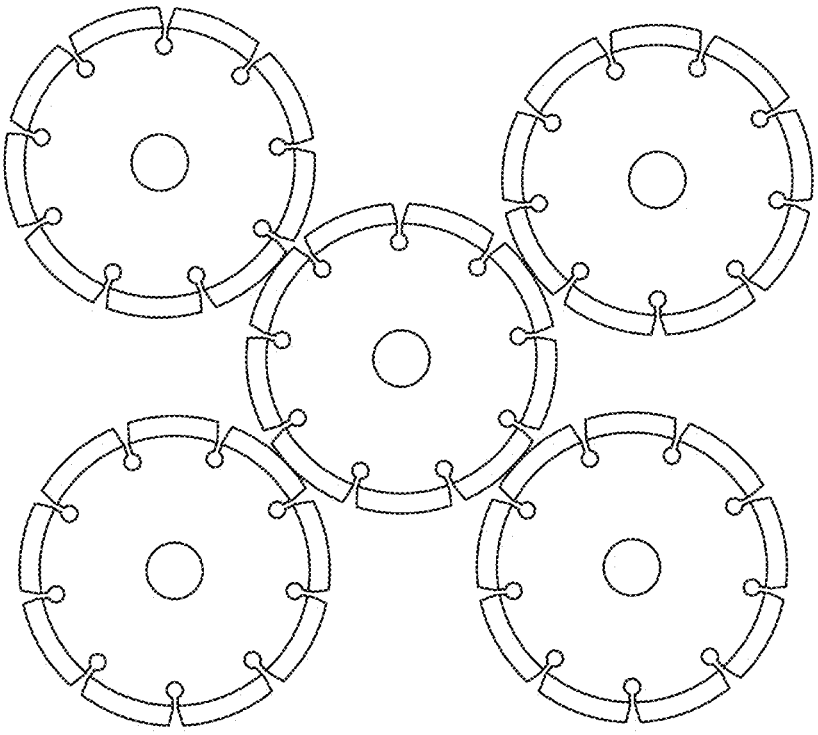
FIG. 7 includes an illustration of a cut-off blade in accordance with an embodiment.

FIG. 5 includes illustration of a portion of an abrasive article 500. The abrasive article 500 includes a core 502, bonding regions 506 and abrasive segments 504. FIG. 6 includes illustration of a portion of an abrasive article 600. The abrasive article 600 includes a core 602, bonding regions 606 and a continuous rim 604. FIG. 7 includes illustration of exemplary cut-off blades formed in accordance with embodiments herein.

Many different aspects and embodiments are possible. Some of those aspects and embodiments are described herein. After reading this specification, skilled artisans will appreciate that those aspects and embodiments are only illustrative and do not limit the scope of the present invention. Embodiments may be in accordance with any one or more of the embodiments as listed below.

EMBODIMENTS

Embodiment 1. An abrasive article, comprising an abrasive component comprising a body, wherein the body comprises:

- a bond matrix including a bond material and abrasive particles contained within the bond matrix;
- an interconnected phase extending through at least a portion of the bond matrix; and
- a discontinuous phase within the bond matrix, wherein a discrete member of the discontinuous phase comprises a macroscopic pore.

Embodiment 2. An abrasive article, comprising an abrasive component including a body, wherein the body comprises:

- a bond matrix including a bond material and abrasive particles contained within the bond matrix;
- an interconnected phase extending through at least a portion of the bond matrix; and
- a porosity of at least 15 vol % for a total volume of the body.

Embodiment 3. The abrasive article of embodiment 2, wherein the body further comprises a discontinuous phase within the bond matrix, wherein a discrete member of the discontinuous phase comprises a macroscopic pore.

Embodiment 4. The abrasive article of embodiment 1 or 3, wherein the discontinuous phase comprises a plurality of discrete members, wherein a majority of the discrete members comprise a macroscopic pore.

Embodiment 5. The abrasive article of embodiment 1, 3, or 4, wherein the discontinuous phase comprises a plurality of discrete members, wherein each member comprises a macroscopic pore.

Embodiment 6. The abrasive article of any one of embodiments 1 to 5, wherein the body comprises a porosity of at least 15 vol %, at least 18 vol %, at least 20 vol %, at least 23 vol %, at least 27 vol %, or at least 30 vol % for a total volume of the body.

Embodiment 7. The abrasive article of any one of embodiments 1 to 6, wherein the body comprises a porosity of at most 35 vol %, at most 31 vol %, at most 29 vol %, at most 25 vol %, or at most 21 vol % for a total volume of the body.

Embodiment 8. The abrasive article of embodiment 6 or 7, wherein at least 90% of the porosity comprises macroscopic pores, or at least 92%, at least 95%, at least 97%, or at least 99% the porosity comprises macroscopic pores.

Embodiment 9. The abrasive article of any one of embodiments 1 and 3 to 8, wherein the body comprises an average pore size of the macroscopic pores of at least 200 microns, at least 250 microns, at least 300 microns, at least 330 microns, at least 360 microns, at least 400 microns, at least 450 microns, at least 470 microns, at least 510 microns, at least 560 microns, at least 600 microns, or at least 630 microns.

Embodiment 10. The abrasive article of any one of embodiments 1 and 3 to 9, wherein the body comprises an average pore size of the macroscopic pores of at most 1.5 mm, at most 1.2 mm, at most 1 mm, at most 900 microns, at most 800 microns, at most 710 microns, at most 670 microns, at most 620 microns, at most 580 microns, at most 520 microns, at most 480 microns, at most 430 microns, at most 390 microns, at most 330 microns, or at most 300 microns.

Embodiment 11. The abrasive article of any one of embodiments 1 and 3, wherein the macroscopic pore is connected to the interconnected phase.

Embodiment 12. The abrasive article of any one of embodiments 4 to 11, wherein each macroscopic pore is connected to the interconnected phase.

Embodiment 13. The abrasive article of any one of embodiments 1 and 3 to 12, wherein at least one discrete member of the discontinuous phase comprises a macroscopic pore including a residue of the interconnected phase.

Embodiment 14. The abrasive article of embodiment 13, wherein the residue is connected to the interconnected phase.

Embodiment 15. The abrasive article of any one of embodiments 1 and 3 to 12, wherein at least one discrete member of the discontinuous phase comprises a material different from the interconnected phase.

Embodiment 16. The abrasive article of any one of embodiments 1, 3 to 12, and 15, wherein the discrete member of the discontinuous phase comprises a material having a melting temperature higher than a melting temperature of the interconnected phase and higher than a melting temperature of the bond material.

Embodiment 17. The abrasive article of any one of embodiments 15 to 16, wherein each discrete member comprises the material.

Embodiment 18. The abrasive article of any one of embodiments 15 to 17, wherein at least one macroscopic pore is defined by the material.

Embodiment 19. The abrasive article of any one of embodiments 15 to 18, wherein at least one macroscopic pore includes the material.

Embodiment 20. The abrasive article of any one of embodiments 15 to 19, wherein the material comprises a ceramic material.

Embodiment 21. The abrasive article of embodiment 20, wherein the ceramic material comprises a metal oxide.

Embodiment 22. The abrasive article of embodiment 21, wherein the metal oxide comprises alumina.

Embodiment 23. The abrasive article of any one of embodiments 1 to 22, wherein the interconnected phase comprises a material that is different from the bond material.

Embodiment 24. The abrasive article of any one of embodiments 1 to 23, wherein the interconnected phase comprises a melting temperature lower than a melting temperature of the bond material.

Embodiment 25. The abrasive article of any one of embodiments 1 to 24, wherein the interconnected phase comprises a melting temperature of at most 1200° C., at most 1180° C., at most 1150° C., at most 1100° C., at most 1050° C., at most 1000° C., or at most 950° C.

Embodiment 26. The abrasive article of any one of embodiments 1 to 25, wherein the interconnected phase comprises a melting temperature of at least 850° C., at least 900° C., at least 950° C., at least 1000° C., at least 1050° C., at least 1100° C., at least 1150° C., or at least 1180° C.

Embodiment 27. The abrasive article of any one of embodiments 1 to 26, wherein the interconnected phase comprises a metal or consists essentially of a metal.

Embodiment 28. The abrasive article of any one of embodiments 1 to 27, wherein the interconnected phase comprises copper, tin, zinc, or a combination thereof.

Embodiment 29. The abrasive article of any one of embodiments 1 to 28, wherein the interconnected phase comprises an alloy including copper.

Embodiment 30. The abrasive article of any one of embodiments 1 to 29, wherein the interconnected phase comprises bronze, brass, copper, or any combination thereof.

Embodiment 31. The abrasive article of any one of embodiments 1 to 30, wherein a melting temperature of the bond material is at least 20° C. higher than a melting temperature of the interconnected phase, at least 50° C., at least 100° C., or at least 150° C. higher than the melting temperature of the interconnected phase.

Embodiment 32. The abrasive article of any one of embodiments 1 to 31, wherein a melting temperature of the bond material is at least 1200° C., at least 1220° C., at least 1250° C., or at least 1300° C.

Embodiment 33. The abrasive article of any one of embodiments 1 to 32, wherein the bond material comprises a melting temperature of at most 1700° C., at least 1600° C., or at most 1500° C.

Embodiment 34. The abrasive article of any one of embodiments 1 to 33, wherein the bond material comprises metal or consists essentially of metal.

Embodiment 35. The abrasive article of any one of embodiments 1 to 34, wherein the bond material comprises a transition metal element, a rare earth element, or any combination thereof.

Embodiment 36. The abrasive article of any one of embodiments 1 to 35, wherein the bond material comprises an element including iron, tungsten, cobalt, nickel, chromium, titanium, silver, cerium, lanthanum, neodymium, magnesium, aluminum, niobium, tantalum, vanadium, zirconium, molybdenum, palladium, platinum, gold, copper, cadmium, tin, indium, zinc, an alloy thereof, or any combination thereof.

Embodiment 37. The abrasive article of any one of embodiments 1 to 36, wherein the bond material comprises an iron-based alloy.

Embodiment 38. The abrasive article of any one of embodiments 1 to 37, wherein the abrasive particles comprise a material including a carbide, nitride, oxide, boride, or any combination thereof.

Embodiment 39. The abrasive article of any one of embodiments 1 to 38, wherein the abrasive particles comprise a superabrasive particle.

Embodiment 40. The abrasive article of any one of embodiments 1 to 39, wherein the abrasive particles comprises aluminum oxide, titanium diboride, titanium nitride, tungsten carbide, titanium carbide, aluminum nitride, garnet, fused alumina-zirconia, sol-gel derived abrasive particles, diamond, silicon carbide, boron carbide, cubic boron nitride, or any combination thereof.

Embodiment 41. The abrasive article of any one of embodiments 1 to 40, wherein the body comprises filler.

Embodiment 42. The abrasive article of embodiment 41, wherein the filler comprises isolated particles contained in the bond material and separated from the interconnected phase.

Embodiment 43. The abrasive article of embodiment 41 or 42, wherein the filler comprises an oxide, a carbide, a nitride, a boride, or any combination thereof.

Embodiment 44. The abrasive article of any one of embodiments 1 to 43, wherein the filler comprises graphite, tungsten carbide, boron nitride, tungsten disulfide, silicon carbide, aluminum oxide, or any combination thereof.

Embodiment 45. A method of forming an abrasive article, comprising:

forming a porous green body comprising a mixture including a bond material, an infiltrant material, and abrasive particles.

Embodiment 46. The method of embodiment 45, wherein the infiltrant material is a solid material.

Embodiment 47. The method of embodiment 45 or 46, wherein the infiltrant material comprises macroscopic particles.

Embodiment 48. The method of any one of embodiments 45 to 47, wherein the infiltrant material comprises solid macroscopic particles, hollow macroscopic particles, or a combination thereof.

Embodiment 49. The method of any one of embodiments 47 to 48, wherein the macroscopic particles comprises an average size of at least 300 microns, at least 330 microns, at least 360 microns, at least 400 microns, at least 450 microns, at least 470 microns, at least 510 microns, at least 560 microns, at least 600 microns, at least 630 microns, at least 660 microns, or at least 710 microns.

Embodiment 50. The method of any one of embodiments 47 to 49, wherein the macroscopic particles comprises an average size of at most 750 microns, at most 710 microns, at most 670 microns, at most 620 microns, at most 580 microns, at most 520 microns, at most 480 microns, at most 430 microns, at most 390 microns, or at most 330 microns.

Embodiment 51. The method of any one of embodiments 45 to 50, wherein the infiltrant material is different from the bond material.

Embodiment 52. The method of any one of embodiments 45 to 51, wherein the infiltrant material has a melting temperature that is lower than a melting temperature of the bond material.

Embodiment 53. The method of any one of embodiments 45 to 52, wherein the infiltrant material comprises an inorganic material.

Embodiment 54. The method of any one of embodiments 45 to 53, wherein the infiltrant material comprises a metal.

Embodiment 55. The method of any one of embodiments 45 to 54, wherein the infiltrant material comprises copper.

Embodiment 56. The method of any one of embodiments 45 to 55, wherein the infiltrant material comprises an alloy including copper.

Embodiment 57. The method of any one of embodiments 45 to 56, wherein the porous green body comprises a filler material.

Embodiment 58. The method of any one of embodiments 45 to 57, further comprising heating at least a portion of the green body.

Embodiment 59. The method of embodiment 58, wherein heating comprises infiltrating at least a portion of the green body.

Embodiment 60. The method of embodiment 58 or 59, wherein heating comprises simultaneously sintering and infiltrating at least a portion of the green body.

Embodiment 61. The method of any one of embodiments 58 to 60, wherein heating comprises melting the infiltrant material within the green body to form a liquid and infiltrating at least a portion of the green body with the liquid.

Embodiment 62. The method of any one of embodiments 58 to 61, wherein heating is performed at a temperature higher than a melting temperature of the infiltrant material and lower than a melting temperature of the bond material.

Embodiment 63. The method of any one of embodiments 58 to 62, wherein heating is performed at a temperature at least 900° C., at least 950° C., at least 1000° C., at least 1050° C., at least 1100° C., at least 1150° C., or at least 1180° C.

Embodiment 64. The method of any one of embodiments 58 to 63, wherein heating is performed at a temperature at most 1200° C., at most 1180° C., at most 1150° C., at most 1100° C., at most 1050° C., at most 1000° C., or at most 950° C.

Embodiment 65. The method of any one of embodiments 58 to 64, further comprising applying another infiltrant material to at least a surface portion of the green body.

Embodiment 66. The method of any one of embodiments 45 to 65, further comprising simultaneously attaching the body to a core.

Embodiment 67. The method of embodiment 66, wherein attaching the body to a core is performed simultaneously while infiltrating at least a portion of the green body.

Embodiment 68. The method of embodiment 66, wherein attaching the body to a core comprises welding, brazing, or a combination thereof.

Embodiment 69. The method of embodiment 68, wherein welding comprises utilizing a laser, an electron beam, or a combination thereof.

Embodiment 70. A method of forming an abrasive article, comprising:

forming a porous green body, wherein the porous green body comprises a mixture including a bond material, abrasive particles, and a pore former including macroscopic particles that are different from the abrasive particles; and infiltrating at least a portion of the green body.

Embodiment 71. The method of embodiment 70, wherein the macroscopic particles are hollow.

Embodiment 72. The method of embodiment 70 or 71, wherein the macroscopic particles comprise a ceramic material including a metal oxide.

Embodiment 73. The method of embodiment 72, wherein the ceramic material comprises alumina.

Embodiment 74. The method of any one of embodiments 70 to 73, wherein the macroscopic particles comprise an average size of at least 150 microns, at least 200 microns, at least 250 microns, at least 300 microns, at least 330 microns, at least 360 microns, at least 400 microns, at least 450 microns, at least 470 microns, at least 510 microns, at least 560 microns, at least 600 microns, at least 630 microns, at least 660 microns, or at least 710 microns.

Embodiment 75. The method of any one of embodiments 70 to 74, wherein the macroscopic particles comprises an average size of at most 1.5 mm, at most 1.2 mm, at most 1 mm, at most 900 microns, at most 800 microns, at most 750 microns, at most 710 microns, at most 670 microns, at most 620 microns, at most 580 microns, at most 520 microns, at most 480 microns, at most 430 microns, at most 390 microns, or at most 330 microns.

Embodiment 76. The method of any one of embodiments 70 to 74, further comprising heating at least a portion of the green body to form a finally formed abrasive body.

Embodiment 77. The method of embodiment 76, wherein heating comprises sintering and infiltrating, wherein sintering is performed simultaneously with infiltrating.

Embodiment 78. The method of embodiment 76 or 77, further comprising simultaneously attaching the green body to a core while heating at least a portion of the green body.

EXAMPLES

Example 1

Abrasive components were formed as described in embodiments herein. Green bodies were formed including the bond material of stainless steel particles, diamond abrasive particles, and an infiltrant material including copper or bronze macroscopic particles having an average particle size of approximately 300 microns and then heated to form the finally formed abrasive components. The content of the infiltrant material of each sample relative to the respective weight of the abrasive component is included in Table 1.

TABLE 1

| Samples | Infiltrant materials | Contents of infiltrant |
|---|---|---|
| S1 | Copper | 18 wt. % |
| S2 | Copper | 23 wt. % |
| S3 | Bronze | 34 wt. % |
| S4 | Bronze | 44 wt. % |

Embodiments disclosed herein represent a departure from the state of the art. The abrasive component as described in embodiments herein can have a body including a controlled porosity, such as a certain pore size and/or content of pores. The controlled porosity, in combination with the bond material, abrasive particles, the interconnected phase, or any combination thereof, can allow the abrasive article including the abrasive component to have reduced contact surface with a workpiece, improved grinding performance, such as improved quality of the finished surface of a workpiece, and reduced power draw. The processes described in embodiments herein can allow formation of the abrasive component including a controlled porosity to have improved mechanical strength and improved performance in material removing operations.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims. Reference herein to a material including one or more components may be interpreted to include at least one embodiment wherein the material consists essentially of the one or more components identified. The term "consisting essentially" will be interpreted to include a composition including those materials identified and excluding all other materials except in minority contents (e.g., impurity contents), which do not significantly alter the properties of the material. Additionally, or in the alternative, in certain non-limiting embodiments, any of the compositions identified herein may be essentially free of materials that are not expres sly disclosed. The embodiments herein include range of contents for certain components within a material, and it will be appreciated that the contents of the components within a given material total 100%.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Separate embodiments may also be provided in combination in a single embodiment, and conversely, various features that are, for brevity, described in the context of a single embodiment, may also be provided separately or in any subcombination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive.

What is claimed is:

1. An abrasive article, comprising an abrasive component including a body, wherein the body comprises:

a bond matrix including a bond material including a metal material and abrasive particles contained within the bond matrix;

an interconnected phase extending through at least a portion of the bond matrix including a different metal material than the bond material, wherein the body comprises at least 15 vol % and at most 70 vol % of the interconnected phase for a total volume of the body; and a discontinuous phase comprising macroscopic pores, wherein the discontinuous phase is distinct from the interconnected phase, the bond material, and the abrasive particles.

2. The abrasive article of claim 1, wherein the body comprises an average pore size of the macroscopic pores of at least 200 microns and at most 1.5 mm.

3. The abrasive article of claim 1, wherein the body comprises a porosity of at least 10 vol % for the total volume of the body.

4. The abrasive article of claim 3, wherein at least 90% of the porosity comprises macroscopic pores.

5. The abrasive article of claim 1, wherein at least a majority of the macroscopic pores are discrete.

6. The abrasive article of claim 1, wherein each of the macroscopic pores is defined at least partially by the bond material, interconnected phase, or both.

7. The abrasive article of claim 1, wherein the body comprises at least 15 wt % and at most 90 wt % of the bond material for a total weight of the body.

8. The abrasive article of claim 1, wherein the body comprises a porosity of at most 50 vol %.

9. The abrasive article of claim 1, wherein the interconnected phase comprises a melting temperature lower than a melting temperature of the bond material.

10. The abrasive article of claim 1, wherein the bond material comprises an alloy.

11. The abrasive article of claim 1, wherein the abrasive particles comprise aluminum oxide, titanium diboride, titanium nitride, tungsten carbide, titanium carbide, aluminum nitride, garnet, fused alumina-zirconia, sol-gel derived abrasive particles, diamond, silicon carbide, boron carbide, cubic boron nitride, or any combination thereof.

12. An abrasive article, comprising an abrasive component including a body, wherein the body comprises:

a bond matrix including a bond material including a metal material and abrasive particles contained within the bond matrix, wherein the body comprises at least 8 vol % and at most 50 vol % of abrasive particles for a total volume of the body;

an interconnected phase extending through at least a portion of the bond matrix including a different metal material than the bond material; and a porosity comprising discrete macroscopic pores having a pore size of at least 200 microns.

13. The abrasive article of claim 12, wherein the bond material comprises an alloy including iron.

14. The abrasive article of claim 12, wherein the body comprises an average pore size of the macroscopic pores of at most 1.5 mm.

15. The abrasive article of claim 12, wherein the porosity is at least 10 vol % and at most 60 vol % for the total volume of the body.

16. The abrasive article of claim 15, wherein at least 90% of the porosity comprises discrete macroscopic pores.

17. The abrasive article of claim 12, wherein the interconnected phase is at least 15 vol % and at most 70 vol % for the total volume of the body.

18. The abrasive article of claim 12, wherein the body comprises at least 15 wt % and at most 90 wt % of the bond material for a total weight of the body.

19. The abrasive article of claim 12, wherein the body comprises at most 8 vol % of pores having a pore size of at most 150 microns for the total volume of the body.

20. The abrasive article of claim 12, the interconnected phase comprises a melting temperature lower than a melting temperature of the bond material.

* * * * *